United States Patent [19]

Nagata

[11] Patent Number: 4,581,004

[45] Date of Patent: Apr. 8, 1986

[54] PAPER PRESSING DEVICE FOR AN ARBOR TURRET PACKAGING MACHINE

[75] Inventor: Tomizo Nagata, Tokyo, Japan

[73] Assignee: The Japan Tobacco & Salt Public Corporation, Japan

[21] Appl. No.: 582,760

[22] Filed: Feb. 23, 1984

[30] Foreign Application Priority Data

Jul. 12, 1983 [JP] Japan ..... 58-125375

[51] Int. Cl.[4] ..... B31B 1/32; B31B 3/02

[52] U.S. Cl. ..... 493/164; 493/142; 493/176; 493/332; 53/575; 53/234; 53/387

[58] Field of Search ..... 493/164, 163, 166, 175, 493/176, 456, 332; 53/575, 234, 387

[56] References Cited

U.S. PATENT DOCUMENTS

| | | | |
|---|---|---|---|
| 736,780 | 8/1903 | Reynolds | 493/175 |
| 2,089,722 | 8/1937 | Vergobbi | 493/164 |
| 2,131,633 | 9/1938 | Lindholm | 493/175 |
| 4,044,528 | 8/1977 | Black et al. | 53/192 |
| 4,338,082 | 7/1982 | Evers | 493/190 |
| 4,349,345 | 9/1982 | Bodendoerfer | 493/295 |

*Primary Examiner*—Lowell A. Larson
*Assistant Examiner*—William E. Terrell
*Attorney, Agent, or Firm*—Armstrong, Nikaido, Marmelstein & Kubovcik

[57] ABSTRACT

A paper pressing device has a pair of presser plates being positioned opposite the lateral faces of an arbor. The opening and closing operation of the presser plates is conducted by a lever which is engaged with an oscillator by a spring. The oscillator adjusts the length of the spring so that the pressing force of the presser plates is constant irrespective of the force of inertia.

3 Claims, 6 Drawing Figures

PAPER PRESSING DEVICE FOR AN ARBOR TURRET PACKAGING MACHINE

BACKGROUND OF THE INVENTION

The present invention relates to a packaging machine for packing cigarettes or other articles, and more particularly to a paper pressing device to be used for an arbour turret packaging machine.

This invention is suitably applicable to the type of a machine which makes a well known soft pack or cigarette bucket to be used for cigarette packing from soft and not thick material such as wrapping paper by winding it around the periphery of an arbour. It particularly provides a device for folding the packing material in a space defined between one of the lateral faces of the arbour and a pressure plate positioned opposite thereto as well as opening and closing mechanisms.

An arbour turret for this type of packaging machine has a plurality of arbours on its circumference at equal spaces and is formed in disc shape. The arbour turret is turned in a stepping manner on its center axis and moved intermittently. A packing paper supplying device or feeder is provided at a fixed position adjacent the arbour turret. The term "packing paper" used herein refers to packing material which is commonly used for a soft pack, such as aluminum foil for making an inner pack and outer wrapping paper. However, other material may be used. According to the above mentioned type of a packaging machine, the aluminum foil and outer wrapping paper are supplied by different feeders located at different positions.

The aluminum foil is supplied along one of the lateral faces of the arbour and wound around its four faces to form a sleeve shape. One end of the sleeve shaped aluminum foil is folded forming a small pack having an open top at its other end.

Furthermore, in order to place said wrapping paper upon said small pack made of aluminum foil, the wrapping paper is supplied along said lateral face of the arbour and wound around the four faces thereof in the same manner as described above to form a sleeve shape, one end of which is folded in the bottom of the aluminum pack to form the outer pack. As a result, a small double pack is produced.

A cigarette supplying device or feeder is provided at a fixed place adjacent the arbour turret. Cigarettes, after processed, are orderly arranged in a bundle of three layers, i.e., 6 pieces, 7 pieces and 6 pieces from the top. Said packaging machine is equipped with a cigarette supplying device or feeder from where a bundle of cigarettes is fed into the cylindrical bore of said arbour.

Usually, the arbour turret is provided with means for adhering the overlapped portions of the small pack made of wrapping paper. If necessary, heating and cooling equipments may be provided in order to fix the portions where adhesive is applied.

The bundle of cigarettes is pushed by a pusher through an aperture on the arbour, and pushed out into the pack formed on the arbour for containing the bundle of cigarettes and discharged therefrom as a small package. However, this small package has still an open end at its top as mentioned above and the folding and sealing operations are conducted in the next process.

It is important for this type of packaging machine, which makes a small pack by means of receiving aluminum foil and wrapping paper from feeders positioned adjacent the arbour turret and winding them around the arbour, to receive the supplied packing paper on the lateral face of the arbour and hold it precisely. It is more important to hold the end portions in order to make overlapped portions on the packing paper wound around the arbour. Particularly, when plural sheets of packing paper are used, one over another, it has a vital effect on finish of the resulted product whether said holding means properly align and hold the sheets.

Because of the above mentioned reasons, various proposals have been presented for improving the device. One such successful improvement is described in detail in the specification of Japanese Patent Application No. 57-24508 filed by the present applicant.

It discloses an arbour turret packaging machine which comprises an arbour turret being arranged in disc shape and caused to turn in a stepping manner, means for supplying packing paper to one of lateral faces of the arbour, means for folding the packing paper into a small pack which is wound around said arbour, means for holding the packing paper on the lateral faces of said arbour, whereby said holding means comprises presser plates being positioned opposite the lateral faces of the arbour, lever means provided at one ends of said presser plates, a disc cam to actuate said lever means and oscillating means for turning the disc cam forwardly and backwardly for a predetermined angle.

In recent years, the production speed or turning speed of this type of packaging machine has been rapidly increased. As a result, a new problem is created for the machine. More specifically, as the turning speed of the machine increases, the force of inertia to be produced in the arbour turret is rapidly increased. That is to say, the pressing force of the presser plates is varied. When the arbour turret starts and stops, the pressure on the outside of the arbour is weakened. In an extreme case, the pressure is entirely lost, thus making the presser plates unable to hold the packing paper, particularly the overlapped portions.

The present invention is accomplished in order to overcome the above mentioned disadvantages by eliminating the variation of pressure caused by the force of inertia and provides a stable packaging machine which is operable at high speed.

It is possible for the arbour turret to choose a motion curve out of various modes along which it turns. However, no matter which mode is selected, it is impossible for the turret to completely eliminate the angular acceleration which is inevitably produced by turning motion. Once the angular acceleration is produced in an object having mass, the turning effect, which is equal to the product of the inertia moment of the object and its angular acceleration, is produced. This is apparent from Newton's law.

Heretofore, the presser plates of the arbour turret are arranged such that they are opened and closed forwardly and backwardly in the progressing direction. Therefore, the presser plates having mass are directly affected by angular acceleration.

The pressure of the presser plates on the outer faces of the arbour is caused by a resilient spring. However, the angular acceleration, which is given to the presser plates, tends to open and close the presser plates on their axes because of the turning effect. As a result, the force given by the spring competes with that given by the angular acceleration, thus producing effect caused by the mutual force relation. That is to say, when the force of inertia caused by angular acceleration is superior, the pressing force of the presser plates becomes minus and loses their functions. It is known that angular acceleration is not only given in the plus direction but also in the minus direction. If minus angular acceleration is given, the pressing force of the plesser plates is multiplied and becomes excessive. As a result, the arbour is damaged. This explanation is also applicable to the other presser plate which is provided at a position symmetric with respect to the above mentioned presser plate, and which is caused to press one of the arbour faces in the reversed direction.

SUMMARY OF THE INVENTION

The present invention is accomplished in order to overcome the above mentioned disadvantages.

It is therefore an object of the present invention to provide a packaging machine which is reliable in high speed operation by eliminating variation of above mentioned pressing force with the help of the force of inertia.

Another object of the invention is to provide a pressure plate device which compensates variation of the pressing force of the presser plates with the help of the force of inertia.

A further object of the invention is to increase productive capacity of the packaging machine by increasing the pressing force of the presser plate against the arbour with the help of the force of inertia.

To achieve the above mentioned objects, there is provided a paper pressing device for an arbour turret packaging machine comprising an arbour turret arranged generally in disc shape and caused to turn in a stepping manner, means for supplying packing paper to one of lateral faces of an arbour, means for folding the packing paper into a small pack which is wound around said arbour, means for holding the packing paper on the lateral faces of said arbour, the means for holding the packing paper further comprising presser plates positioned opposite the lateral faces of said arbour, lever means for opening and closing said presser plates provided on one ends thereof, oscillator means provided on a base of said arbour, spring means stretched between said oscillator means and lever means, and characterized in that the pressing force of said presser plates is controlled by adjusting the length of said spring means by way of said oscillator means.

According to the present invention, the oscillator is oscillated by means of the force of inertia produced by angular acceleration. The distance between the oscillator and the lever over which a spring is stretched is changed by means of the oscillator. In other words, the stretched length of the spring is controlled by the oscillator. The pressing force of the presser plates, which is apt to be increased or decreased by angular acceleration, is compensated by the tension of the spring.

The present invention is conveniently applicable to an ordinary packaging machine of the type mentioned above because the presser plates are symmetrically provided at the front and rear faces of the arbour. Since the presser plates are symmetrically provided in the manner mentioned above, the variation of the pressing force of the presser plates caused by the force of inertia is also symmetrical. Therefore, when the front and rear presser plates adjacent each other are constructed as a pair which have a symmetric oscillatory displacement, it is possible to perform the above mentioned function by using a single oscillator.

DETAILED DESCRIPTION OF THE EMBODIMENTS

A preferred embodiment of the present invention will be described with reference to the accompanying drawings.

Figure 1:
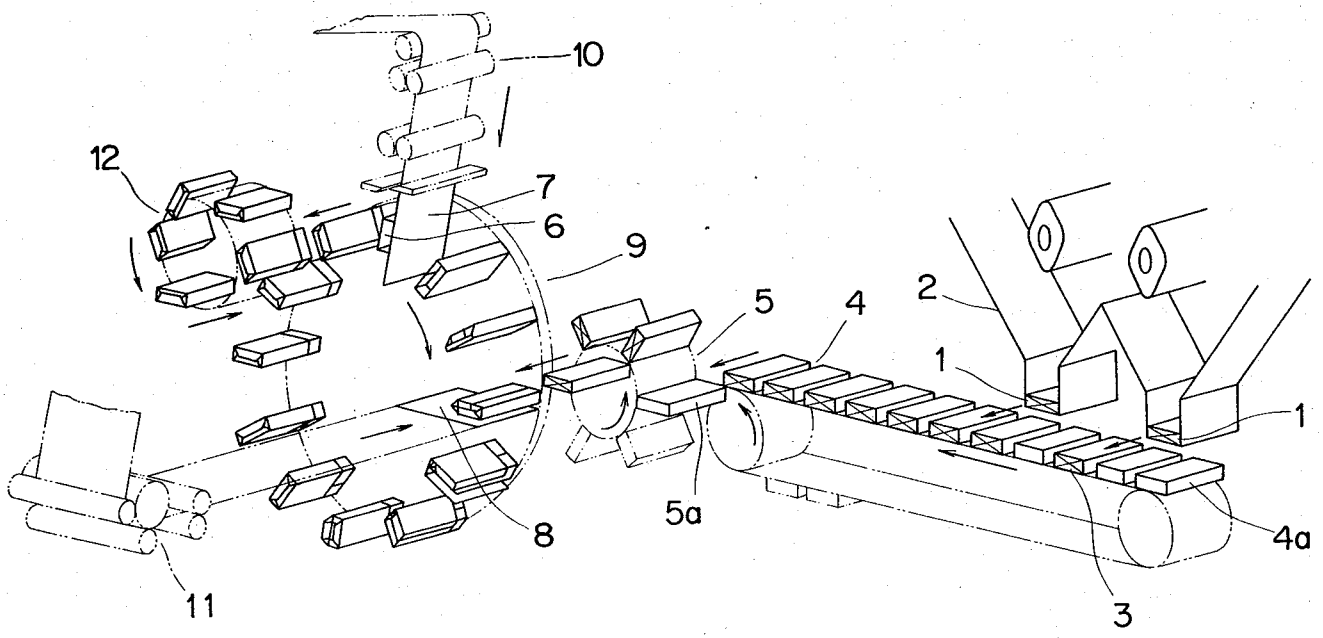
FIG. 1 is a schematic view showing roughly each process of the packaging machine according to the present invention.

FIG. 1 is a schematic view showing roughly each process of overall assembly line of the cigarette packaging machine according to the present invention. Firstly, each process will be described.

Cigarettes 1 are stored in a hopper 2 which has a pendulent exit therebeneath. The cigarettes 1 are extracted from the exit in the form of a bundle consisting 7 pieces, 6 pieces and 7 pieces of cigarettes. Said bundle 3 of cigarettes is formed in the inside of a bucket 4*a*. In the drawing, an example is shown which has two exits taking care of the bucket 4*a* in turn. The bucket 4*a* is provided at an endless bucket conveyer system 4. When the system is operated, the bucket 4*a* is moved for a pitch intermittently in the direction as shown by an arrow.

When the bucket 4*a* reaches the foremost position of the conveyor system, the bundle of cigarette is transferred to a compression turret 5.

Said turret 5 is equipped with a bucket 5*a* for storing said cigarette bundle 3. The cigarette bundle 3 is slightly compressed therein at its four sides so that the cigarette bundle 3 may be inserted into an arbour 6 smoothly which will be described hereinafter.

A plurality of arbours 6 are provided on the circumference of an arbour turret 9. In the drawing, one embodiment is shown which has twelve arbours at equal spaces.

As shown in the drawing, a predetermined size of aluminum foil 7 is supplied from an aluminum foil supplying device or feeder 10 along a forward lateral face of one of the arbours 6 in the turning direction and wound around the periphery of the arbour 6. The arbour turret 9 is intermittently turned only in the clockwise direction as shown by an arrow in the drawing.

At a position where the arbour 6 is progressed, a predetermined size of wrapping paper 8 is supplied from a wrapping paper supplying device or feeder 11 along the forward lateral face of the arbour 6 in the turning direction and wound around the periphery of the arbour 6. The periphery of the arbour 6 is already wound around by said aluminum foil 7 at this time. Therefore, if the wrapping paper is wound around the arbour, a small pack consisting of two sheets of packing material, i.e., aluminum foil and wrapping paper is formed.

As soon as the aluminum foil 7 is supplied to the arbour 6, it is wound around the arbour 6 as mentioned above and forms a sleeve shape, one end of which is folded in an opening end of said arbour 6 and forms a small pack having a bottom, while the arbour turret 9 keeps intermittent turn. Likewise, the above mentioned wrapping paper, which is supplied to the surface of the aluminum foil, is also folded in sleeve shape and further folded into a small pack having a bottom at its one end but a double pack this time.

The wrapping paper 8 is provided with an adhesive in advance at predetermined places and their fixture is achieved in the above mentioned winding and folding processes. In order to assure the fixing operation of the adhesive portions thereof, heating and cooling devices are provided.

On the other hand, the bundle of cigarettes is inserted into the other opening end of the arbour 6 from the compression turret 5 while the arbour turret 9 keeps turning.

When the arbour 6 is carried to a predetermined transfer position for transferring the cigarettes to a top-folder turret 12 keeping said small pack wound around and keeping the bundle of cigarettes stored inside thereof, the bundle 3 of cigarettes is pushed out through the open end of the arbour 6 by way of a pusher (not shown), which is inserted from said open end for the cigarette bundle 3. As a result, the cigarette bundle 3 is inserted deep into said small pack. At the same time, it is discharged from said arbour 6 together with the small pack and inserted into an open end of the top-folder turret 12.

Nextly, the arbour turret 9 will be described further in detail by referring to FIGS. 2 and 3.

Figure 2:
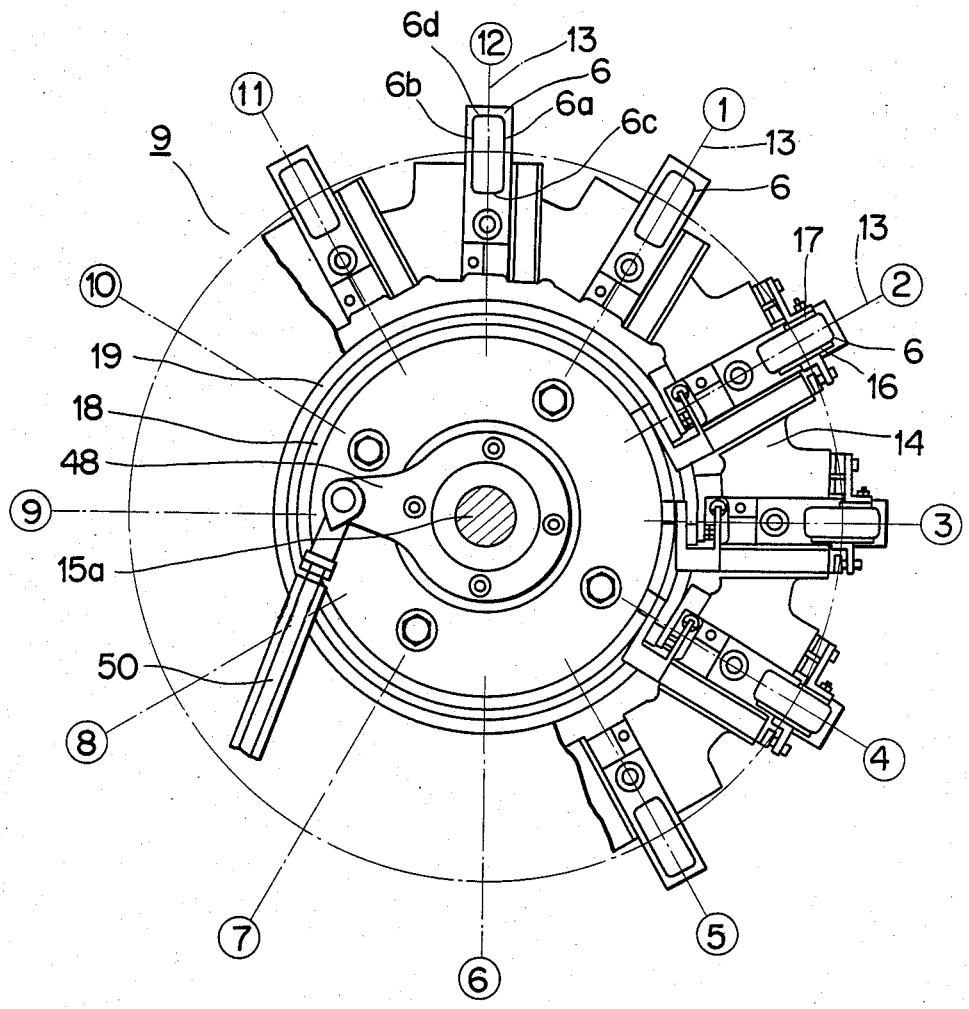
FIG. 2 is a partially broken away front view showing the important parts of the arbour turret in FIG. 1.
Figure 3:
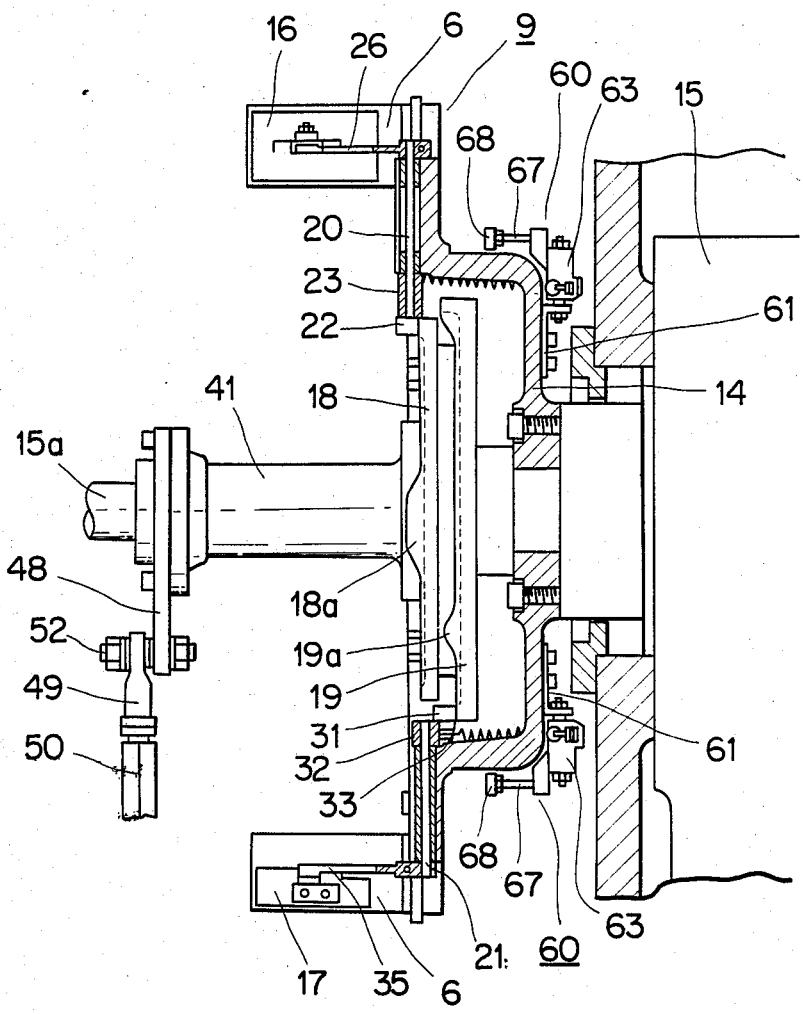
FIG. 3 is a partially sectional side view of the arbour turret in FIG. 2.

FIG. 2 is a front view of the arbour turret 9 of the packaging machine shown in FIG. 1. In order to obtain an easy understanding, a part of the arbours are omitted from the drawing. Also, lever means for the arbour 6 are not all shown in the drawing. However, the details of it is shown in the enlarged view in FIG. 4. In FIG. 3, a side view of the arbour in FIG. 2 is shown.

The circumference of the arbour turret 9 is divided into twelve equal spaces by division lines 13 and twelve arbours of a rectangular shape are provided on the division lines 13. Each arbour 6 has a pair of lateral faces **6*a*, 6*b* in parallel with the division line 13. The face 6*a* is provided at the front face of the arbour 6 in the progressing direction. The turret base 14 disc shaped and which carries said arbours 6**, is stopped turning at every 1/12 turn and turned intermittently in the clockwise direction in the drawing.

The turning motion of the turret base 14 is conducted by the output axis, or axis **15*a* of the turret base 14, of the well known index apparatus 15 which is set to index the turn cycle as 130° turn and 230° stop. Therefore, the turret base 14** progresses for 130° along the circumference in 130° time and stops in 230° time, while the machine is turned for 360° or one machine cycle.

A presser plate 16 is provided opposite the lateral face **6*a* and another presser plate 17 is provided opposite the other lateral face 6*b*. The respective presser plates 16 and 17** have lever means as will be described more in detail hereinafter.

Disc cams 18 and 19 are provided in order to open and close the presser plates 16 and 17 by means of said lever means with respect to the vast faces **6*a* and 6*b* of the arbour 6**, respectively.

Disc cam 18 has a raised portion **18*a* and is rotatably mounted on the coaxis of the axis 15*a* of the turret base 14 for activating the presser plate 16. Likewise, the disc cam 19 has a raised portion 19*a* and is rotatably mounted on the coaxis of axis 15*a* for activating the pressure plate 17. The respective disc cam 18 and 19 repeat forward and backward turns for 30° by keeping agreement with the progress angle of the turret 14** and can be switched over one after another.

Now, it will be described how the packing is conducted while the turret base 14 makes a full turn.

As mentioned above, when the turret base 14 makes a full turn, it encounters twelve stops. Since it is convenient to use a dial face of a watch to explain locations, circled numerals are used in the drawing.

At the position of 12 o'clock, FIG. 2, a predetermined size of aluminum foil 7 is received on the face **6*a* of the arbour 6 and held by the presser plate 16. While it is moved to one o'clock, the aluminum foil 7 is folded generally in the shape of letter "L" by using the arbour 6 as a core. In this case, the path for arbour 6 is defined or surrounded by two side walls. Since the aluminum foils, which are projected along the both sides of the arbour 6**, are inclined to remain on the side walls, the aluminum foils are folded in the shape of letter "U".

At one o'clock, arms extended from both sides of said path are reciprocated from the right and left sides along a rear face **6*b* of the arbour 6, tighten the fold of the U shape and then fold the marginal portions of the aluminum foil 7 one over the other. Then, the overlapped marginal portions are held on the rear face 6*b* of the arbour 6 by closing the presser plate 17. In other words, the aluminum foil 7 is wound around the four lateral faces of the arbour 6** and formed a sleeve shape.

Nextly, at two o'clock, the marginal portions of the aluminum foil extended from the face **6*b* are folded by the arms. On the way to three o'clock, the marginal portions of the aluminum foil extended from the face 6*a*** are folded by folder guides provided at both sides of the path.

Because of these folding operations, a small pack is formed, although it is not completed yet. The bottom of the pack is formed at an open end of the arbour 6.

At three o'clock, the cigarette bundle 3 is inserted into the bore of the arbour 6 from the compression turret 5. Simultaneously, a predetermined size of wrapping paper is received on the lateral face **6*a* of the arbour 6 and held by the presser plate 16**.

Then, on the way to four o'clock, the wrapping paper 8 is folded in the shape of letter 'L' along a narrow face C. At this time, a side wall is provided at one side of the path of the arbour 6 facing toward said narrow face **6*c*. The wrapping paper extended along said wall is folded on said face 6*c***.

At four o'clock, the wrapping paper 8 extended on the narrow face **6*c* is folded along the face 6*b* of the arbour 6 by the arm and the marginal portion thereof is folded on the other narrow face 6*d* of the arbour 6 by the arm. In this case, when the wrapping paper is extended on the vast lateral face 6*b*, it is folded in the overlapped portion of the aluminum foil 7. At this time, the presser plate 17** is opened for receiving and holding these wrapping materials.

Then, on the way to 5 o'clock, the other extended marginal portions of the wrapping paper is folded in the shape of letter "L" along the narrow face **6*d* in such a manner as to be folded on the overlapped portion of the aluminum foil still wound around the arbour 6. As a result, the wrapping paper 8 is wound around the arbour 6 as a core and on the aluminum foil 7 which was wound around the arbour 6** to form a sleeve shape.

At five o'clock, a bottom of the sleeve shaped wrapping paper 8 is formed. The wrapping paper may be folded in the open end of the arbour 6 in the same manner as applied to the aluminum foil when it forms the bottom and if necessary, the wrapping paper may be folded together with the aluminum foil at the same time. As a result, a double pack, which is wound around the arbour 6, is formed its bottom being formed on the open end of the arbour 6.

It is advantageous to apply a hot melt adhesive at predetermined places of the wrapping paper 8 before the paper 8 is supplied at three o'clock position.

The fixing of the adhesive places of the small pack made of the wrapping paper 8 is heated by a heater located at a position intermediate five and seven o'clock positions and then cooled by a cooler provided at a position intermediate seven and nine o'clock positions in order to activate and freeze the hot melt adhesive for sure adhesion.

At eleven o'clock, the bundle of cigarettes stored in the bore of the arbour 6 is extruded. When the pusher is applied to the bundle of cigarettes from the aperture of the arbour 6, the bundle of cigarettes is pushed into the double sheets of small pack and at the same time, a small package containing the cigarette bundle is inserted into a top-folder turret 12 which is positioned in the next process.

As apparent from the foregoing processes, the presser device is given important roles which must be carried out while the arbour turret 9 makes a full turn. That is to say, said presser device must receive the supplied aluminum foil 7 and wrapping paper 8 on the arbour 6 and hold them. Whether the holding function of the overlapped portions of the above mentioned packaging material, which is wound around the periphery of the arbour 6, is proper or not has a vital effect on the quality of the finished product.

Figure 4:
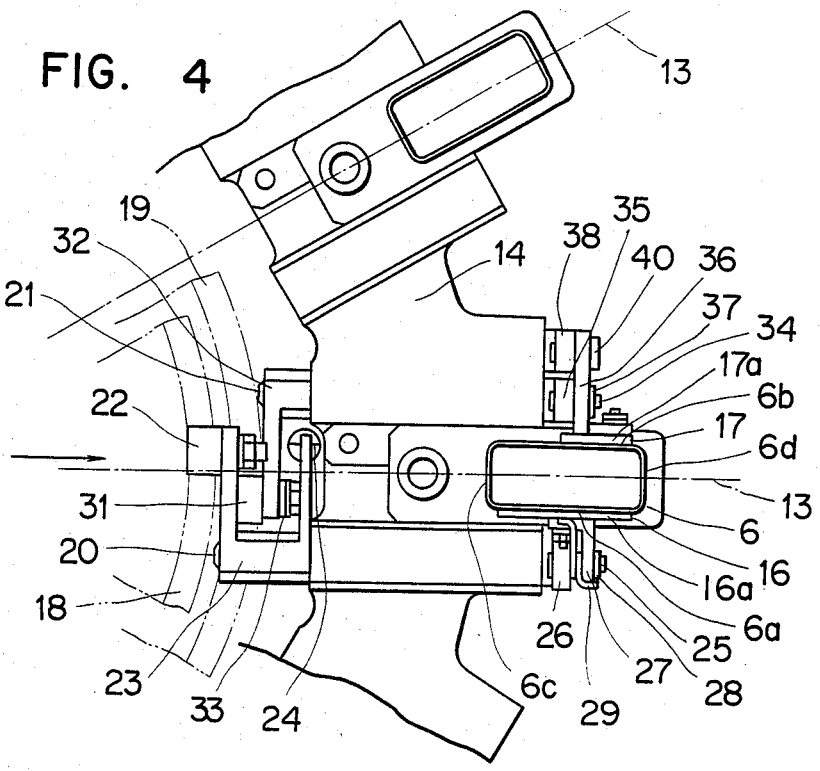
FIG. 4 is a partially enlarged view showing the portion of the arbour in FIG. 2 in detail.
Figure 5:
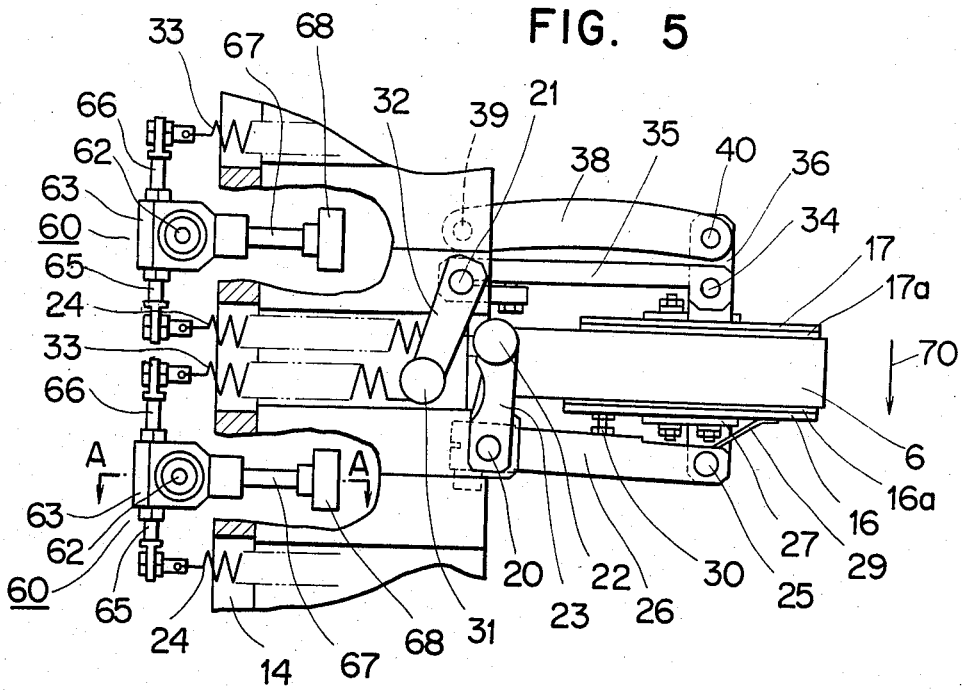
FIG. 5 is a side view of the arbour in FIG. 4 when viewed from the direction as shown by an arrow.

Nextly, the pressing device which forms an important part of the present invention will be described by referring to FIG. 4 and FIG. 5.

To begin with, description will be made on the presser plates 16 and 17, which are provided opposite to the two lateral faces **6*a* and 6*b* of the arbour 6** having four lateral faces, together with the lever mechanism thereof.

A supporting axis 20 (FIG. 3 ) is rotatably mounted on the turret base 14 substantially in parallel with the lateral face **6*a* of the arbour 6. A cam lever 23 having a cam follower 22 is mounted on one end of said axis 20 in the axial direction of the turret base 14**.

A spring 24 (FIG. 5) is stretched between the cam lever 23 and an oscillator 60 which is oscillatably carried on said turret base 14 (FIG. 3) and urge said cam follower 22 to engage with the cam 18. The oscillator 60 will be described more in detail hereinafter.

The other end of the supporting axis 20 is engaged with a lever 26 (FIG. 5) in such a manner that the lever is extruded therefrom. An angle 27 is rotatably mounted on one end of the lever 26 by means of a pin 25. The other end of the angle 27 is engaged with presser plate 16. 28 is a retaining ring. A spring 29 is wound around the pin 25. One end of said spring 29 is connected with the lever 26 and the other end of it is connected with the rear face of the presser plate 16 in order to control the inclination of said presser plate in a fixed direction when the presser plate 16 is released from the arbour 6 and the inclining amount thereof is controlled by a stopper 30 provided at the center portion of the lever 26.

The other presser plate 17 is also equipped with a similar lever mechanism. That is to say, an axis 21 (FIG. 3) is rotatably mounted on the turret base 14 substantially in parallel with the lateral face **6*b* of the arbour 6. A cam lever 32 having a cam follower 31 is mounted on one end of the support axis 21 in the axial direction of the turret base 14. A spring 33 (FIGS. 3 and 5) is stretched between the cam lever 32 and the oscillator 60, which will be described hereinafter, oscillatably carried on the turret base 14 and urge said cam follower 31 to engage with the disc cam 19. The other end of the supporting axis 21 is engaged with a lever 35 which is rotatably supported by a pin 34 at its end portion. Presser plate 17 is provided on the pin 34 by means of an angle 36. 37** is a retaining ring.

The turret base 14 is connected with the angle 36 by means of the lever 38. One end of said lever 38 is rotatably connected to the turret base 14 by means of a pin 39 and the other end thereof is rotatably connected to the angle 36 by means of a pin 40, thus forming a quadrate link. The presser plate 17 is releasable from the arbour 6 when moved parallel with the latter. Rubber plates **16*a* and 17*a* are affixed to the presser plates 16 and 17, respectively, in order to prevent the aluminum foil 7 and packing paper 8 from slipping when they are tightly wound around the arbour 6** and also to prevent the packing material from getting damaged.

Nextly, opening and closing mechanism of the presser plates 16 and 17 will be described by referring to FIG. 3.

At first, the turret base 14 is driven by the output axis of the intermittence index apparatus 15 or the axis **15*a* of the turret and turned around while temporarily stopping at every twelve stopping places provided on the circumference of the base turret 14. An oscillator shaft 41 is rotatably mounted on the co-axis of the axis 15*a* which turns the turret base 14 intermittently. The disc cams 18 and 19 are fixedly mounted on one end of the oscillator shaft 41. Said disc cams 18 and 19 are oscillatably turned in the forward and backward directions by way of oscillation transmitting means which is connected to said oscillator shaft 41. The oscillation angle is in agreement with the distance between the adjacent two stop positions on the turret base 14**.

Said disc cams 18 and 19 are provided with raised portions, respectively, at such positions which correspond to the stop positions on the turret base 14, where the presser plates 16 and 17 are required to effect open and close operations. The raised portion **18*a* of the disc cam 18 is engaged with the cam follower 22 provided at one end of the lever mechanism for the presser plate 16. In the same manner, the raised portion 19*a* of the other disc cam 19 is engaged with the cam follower 31 which activates the presser plate 17. When the disc cams 18 and 19 are revolved forwardly and backwardly on the axis 15, the cam follower 22 follows the raised portion 18*a* of the cam surface 18 and displaces the cam lever 23 which activates the presser plate 16 to conduct its open-close function and like-wise the cam follower 31 follows the raised portion 19*a* of the cam surface 19 and displaces the cam lever 32 which activates the presser plate 17** to conduct its open-close function.

Figure 6:
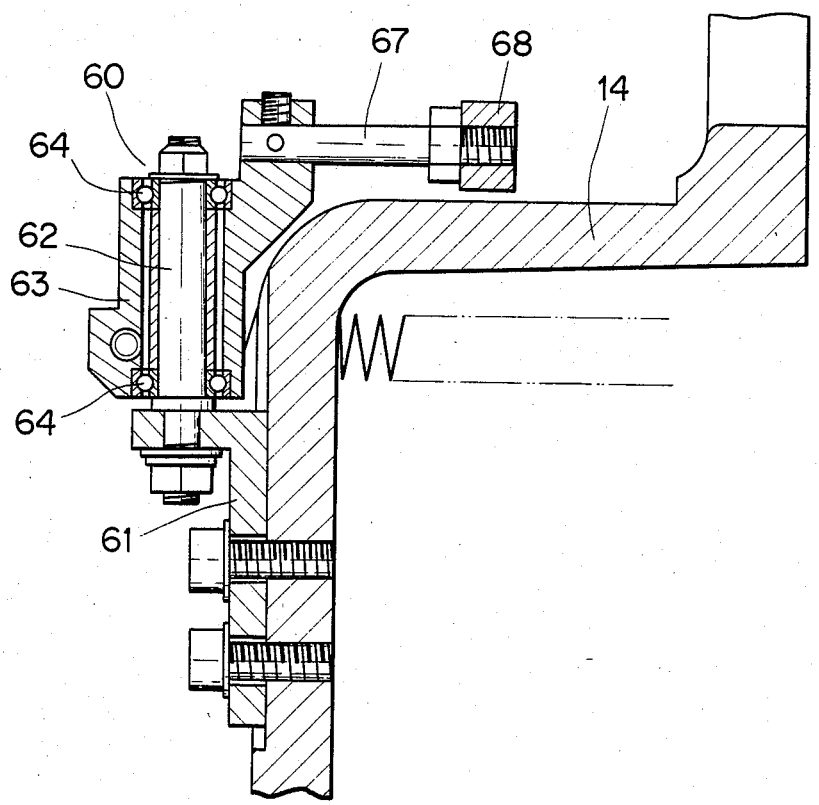
FIG. 6 is a front sectional view of the oscillator taken on the line A—A in FIG. 5.

The oscillator 60 will be described next. Referring to FIGS. 3, 5 and 6, the oscillators 60 are provided behind the turret base 14 and each oscillator is positioned corresponding to each arbour 6 and carried by a bracket 61. A fixed axis 62 is extended in the radial direction of the turret base 14 and carried by the bracket 61 which is fixedly screwed to the turret base 14. A block 63 is rotatably mounted on the fixed axis 62 by means of a ball bearing 64. Said block 63 is equipped with a pin 67 which is extended in the axial direction of the turret base 14 and a pair of spring hangers 65 and 66 of an approximate length which is extended perpendicularly from said pin 67 or extended in the forward and backward directions with respect to the turning direction of the turret base 14. Said pin 67 is provided with a balance weight 68 at its other end. In the drawing, a spring 24 is stretched between the spring hanger 65 and cam lever 23, while a spring 33 is stretched between the spring hanger 66 and cam lever 32. As apparent from FIG. 5, according to the embodiment of the invention shown therein, the presser plates 16, 17, which are symmetric with respect to one of the arbours 6 represent those of another arbours. Likewise, said oscillator 60 corresponding to one of the arbours 6 also represents another oscillators corresponding to another arbours. Therefore, the spring hangers 65, 66, to which the cam levers 23, 32 for activating the presser plates 16, 17 are connected by way of the springs 24, 33, are constructed such that they are also related to the adjacent oscillators 60 as shown in the drawing.

Hereby, we shall review the turret base 14 which turns around in a stepping manner. In FIG. 5, the acceleration is produced in the direction as shown by an arrow. When a force is applied in this direction, a turning effect is produced on the presser plate 16 around the pin 20 or in the right turning direction in the drawing by resisting the tension of the spring 24 and reduces its force for pressing the arbour 6. On the other hand, the other presser plate 17 is given a turning effect around the pin 21 in the right turning direction in the drawing. Therefore, its force for pressing the arbour 6 by means of the spring 33 is that much increased. The similar effect is seen with respect to said oscillator 60. That is to say, the effect given to the balance weight 68 in the direction as shown by an arrow 70 produces a turn effect in the oscillator 60 and causes it to oscillate around the axis 62 in the right turning direction in the drawing. Consequently, the spring hangers 65, 66, which are extended in the right and left directions from said block 63, are oscillated in the right turning direction, as the block 63 oscillates. It will be understood that the spring hanger 65 oscillates in the direction to widen the length of the stretched spring 24 and that the other spring hanger 66 oscillates in the direction to shorten the length of the stretched spring 24. In other words, the spring 24 is increased its tension while the spring 33 is decreased its tension.

The above mentioned increase of tension produced in the spring 24 compensates the above mentioned decrease of the pressing force of the presser plate 16 and the decrease of the tension produced in the spring 33 refuses the increase of the pressing force of the presser plate 17. It will be apparent from the drawing that by means of selecting the sizes of the spring hangers 65 and 66 as well as those of the balance weight 68 and pin 67, the supplemental force, which should be given to the springs 24 and 33, can be adequately controlled.

The turret base 14 is turned in a stepping manner as mentioned above. Therefore, the above mentioned force of inertia is also produced therein. However, it will not be necessary to explain about the effect of the force of enertia here again with respect to the turret base 14, although the force of inertia is adversely effected depending on when the turret base 14 starts and stops.

As explained in the foregoings, the present invention provides a pressing device suitable for a high speed operation packaging machine which is free from such disadvantages as that the pressing force of the presser plate for holding the packing material, particularly the folded portions, is varied depending on the force to be produced in the presser plate, as the turret base 14 progresses and which assures a constant holding function irrespective of the frequency of the start and stop operation of the turret base.

What is claimed is:

1. In a paper device for an arbour turret packaging machine having an arbour turret arranged generally in disc shape and rotatable in a stepping manner and having a plurality of equally spaced arbours thereon, said arbors having lateral faces;

means adjacent said turret for supplying packing paper to each of said arbours as said arbours rotate in said stepped manner to said paper supplying means;

means adjacent said turret for folding the packing paper into a small pack around the lateral faces of said arbour; and means for holding the folded packing paper on said lateral faces;

said means for holding said packing paper further comprising:

a pair of presser plates positioned opposite the lateral faces of said arbour for engaging and holding said paper in engagement with the lateral faces of said arbour, said presser plates exerting a pressing force on said arbor while said arbour turret is rotating; and lever means operatively connected to said presser plates for opening and closing said presser plates;

the improvement comprising oscillator means oscillatably mounted on said arbour turret for rotation therewith and oscillation thereon; and spring means for pressing said presser plates toward the lateral faces of said arbour, stretched between said oscillator means and said lever means;

said oscillator means being means for adjusting the pressing force by adjusting the length of said spring means in response to inertia force produced by the stepwise rotation of said arbour turret.

2. A paper pressing device according to claim 1, wherein said presser plates are provided with rubber plates respectively in order to prevent the packing paper from slipping.

3. A paper pressing device according to claim 1, wherein said lever means incudes a quadrate link.

* * * * *